US005925839A

United States Patent [19]

Schertler

[11] Patent Number: 5,925,839

[45] Date of Patent: Jul. 20, 1999

[54] BRIDGE FOR SUPPORTING THE STRINGS OF A MUSICAL INSTRUMENT

[76] Inventor: Stephan Schertler, CH-6853, Ligornetto, Switzerland

[21] Appl. No.: 09/021,799

[22] Filed: Feb. 11, 1998

[30] Foreign Application Priority Data

Feb. 28, 1997 [AU] Australia ..... 344/97

[51] Int. Cl.[6] ..... G10D 3/04; G10H 3/00

[52] U.S. Cl. ..... 84/298; 84/299; 84/307; 84/723; 84/730; 84/DIG. 24

[58] Field of Search ..... 84/298, 299, 307–309, 84/723–725, 730, DIG. 24

[56] References Cited

U.S. PATENT DOCUMENTS

| | | | |
|---|---|---|---|
| 3,174,380 | 9/1913 | Cookerly et al. . | |
| 4,160,401 | 7/1979 | Tomioka . | |
| 4,228,715 | 10/1980 | Nourney . | |
| 4,657,114 | 4/1987 | Shaw | 84/1.16 |
| 5,109,747 | 5/1992 | Spuler | 84/731 |
| 5,173,565 | 12/1992 | Gunn | 84/298 |

FOREIGN PATENT DOCUMENTS 388071 4/1989 Austria .

*Primary Examiner*—William M. Shoop, Jr.
*Assistant Examiner*—Marlon T. Fletcher
*Attorney, Agent, or Firm*—Friedrich Kueffner

[57] ABSTRACT

A bridge for supporting the strings of a musical instrument including an instrument body and an acoustic transducer, for example, a diaphragm microphone and an air space chamber which is closed airtight and located in front of the sound receiving side of the transducer, wherein the air space chamber extends transversely of the longitudinal extension of the strings and over the zone in which the strings are located next to each other, and wherein the bridge supporting the strings forms a boundary surface of the air space chamber or the bridge is mounted on a wall which forms a boundary surface of the air space chamber.

13 Claims, 3 Drawing Sheets

BRIDGE FOR SUPPORTING THE STRINGS OF A MUSICAL INSTRUMENT

BACKGROUND OF THE INVENTION

1. Field of the Invention

The present invention relates to a bridge for supporting the strings of a musical instrument including an instrument body and an acoustic transducer, for example, a diaphragm microphone and an air space chamber which is closed airtight and located in front of the sound receiving side of the transducer.

2. Description of the Related Art

These types of bridges with an integrated sound pickup are used in string instruments, particularly in guitars, electric guitars and basses, mandolins and the like. These bridges are used for amplifying acoustic string instruments without feedback problems as they usually occur in microphones or, for example in electric guitars and bass guitars, for providing a second musical sound variation because several vibration portions of the instrument body are also transmitted by the sound pickup in the bridge.

In accordance with the prior art, bridges which are simultaneously to be used for sound transmission are equipped with piezoceramic elements, as disclosed in U.S. Pat. Nos. 4,160,401 and 4,228,715. In accordance with these patents, a piezoelectric element is arranged either underneath each string or a rod-shaped piezoelectric element is mounted transversely of the direction of the strings between the bridge and the string support which absorbs the vibrations of all strings.

Also to be mentioned in this connection is Austrian Patent 388,071 which shows and describes a bridge with a sound pickup. The sound pickup includes a housing in which a diaphragm microphone is arranged. A closed chamber-like air space or an air gap is located in front of the sound receiving side of the diaphragm microphone. This air space or air gap is bordered at least partially by an elastic and essentially gas-impermeable material. The housing which is open on one side is closed so as to form the chamber-like air space or air space gap by means of a closure which is formed by this elastic material. This elastic material has a preferred density. The sound pickup is arranged in a recess of the bridge.

The previously known constructions described above are only capable of transmitting and converting into an electrical signal vibrations of strings and/or resonating bodies only with great inaccuracy, limited frequency response and limited sound volume range.

SUMMARY OF THE INVENTION

Therefore, in view of the prior art discussed above, it is the object of the present invention to improve the known constructions particularly with respect to the frequency response and the sound volume range or dynamics of the vibrations and the conversion of the vibrations into electrical signals.

In accordance with the present invention, the air space chamber extends transversely of the longitudinal extension of the strings and over the zone in which the strings are located next to each other, wherein the bridge supporting the strings forms a boundary surface of the air space chamber or the bridge is mounted on a wall which forms a boundary surface of the air space chamber.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
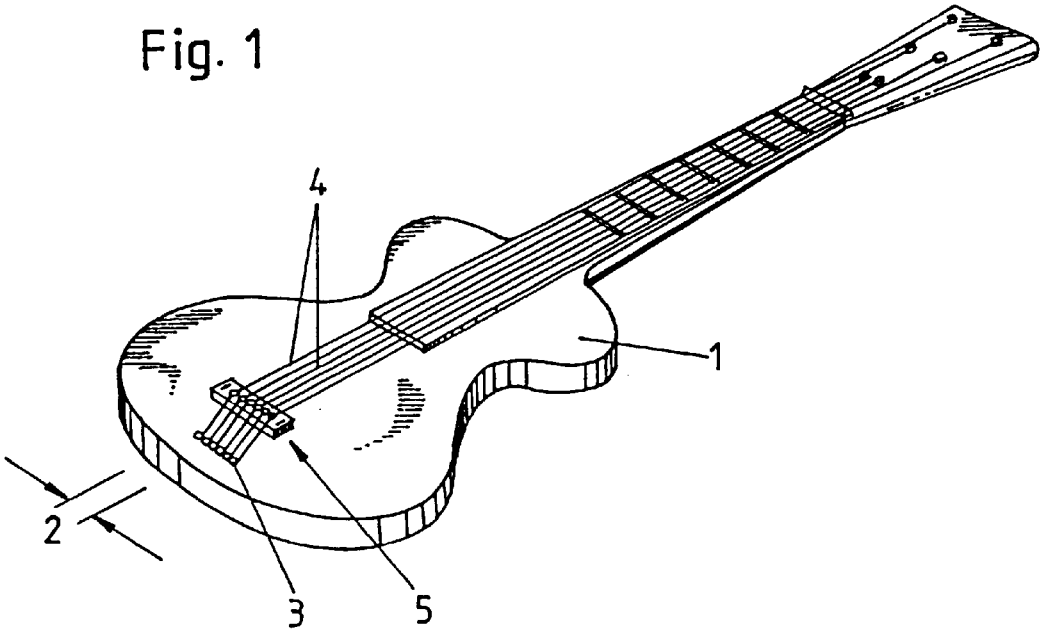
FIG. 1 is a perspective view of a guitar.

FIG. 1 is a perspective view of a guitar with an instrument body 1 and six strings 4 arranged next to each other and extending across a zone 2 of the instrument. This zone 2 is that portion of the instrument in which the strings 4 are located. A bridge 5 according to the present invention, only schematically shown in FIG. 1, is arranged near an anchoring point 3 of the strings 4.

FIG. 1 merely has the purpose of indicating that portion of the string instrument to which the present invention pertains, without limiting the invention to a specific string instrument.

Figure 2:
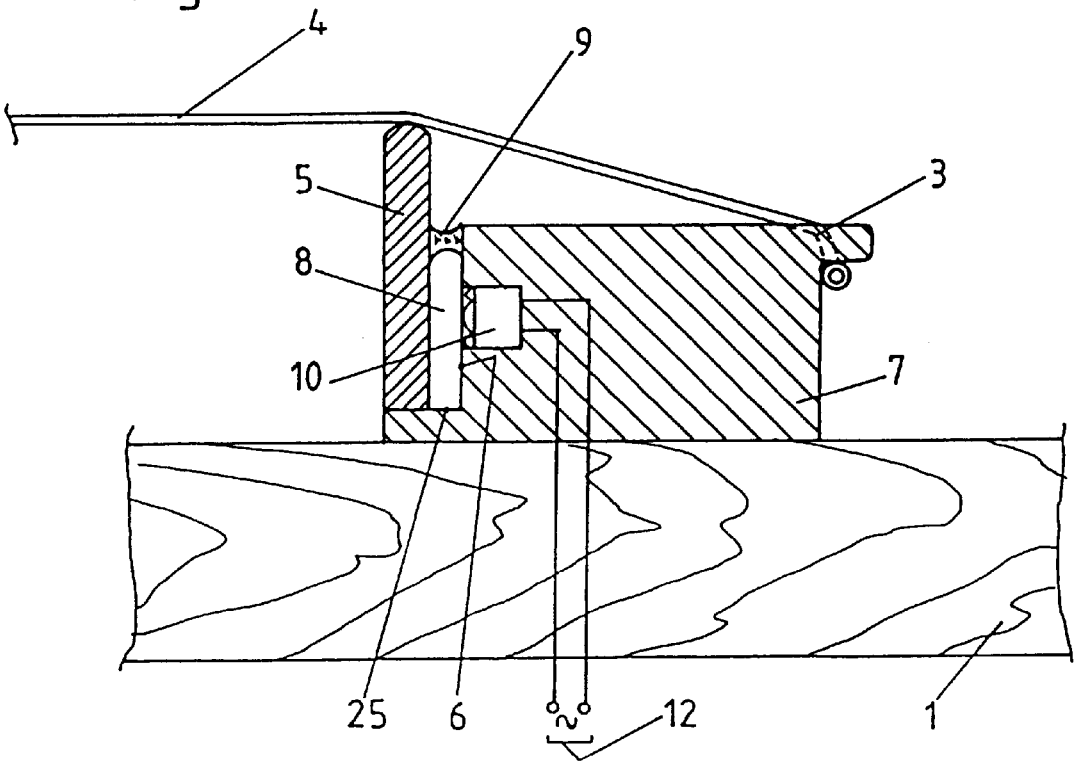
FIG. 2 is a longitudinal sectional view, on a larger scale, of a first embodiment of the present invention.

FIG. 2 of the drawing shows a first embodiment of such a bridge in connection with an electric bass. The bridge 5 on which the strings 4 are supported extends parallel to the end face 6 of a bearing block 7 which forms a supporting component and which is secured to the instrument body 1 and also serves to anchor the ends of the strings 4. This bridge 5 is arranged somewhat spaced apart from the end face 6 of the bearing block 7 or the support component, so that a flat air space chamber 8 remains, wherein three narrow sides of the chamber 8 are formed by an elastic material 9 which tightly closes the air space chamber 8.

The air space chamber 8 has the shape of a flat parallelepiped, wherein the longitudinal extension of the air space chamber is transversely of the strings 4 and across the zone 2 in which the strings 4 of the instrument are located. The air space chamber 8 is closed airtight to all sides. The diaphragm microphone 10 is arranged at the end face 6 of the bearing block 7 or the support component, wherein the electrical connections 12 of the microphone 10 extend out toward the bottom.

The air space chamber 8 is arranged in such a way that the pressure of the strings 4 does not act on the elastic material but on the bridge 5 which, in this embodiment, forms a wide side of the flat parallelepiped air space chamber 8. As a result of this configuration, deep frequencies are transmitted very well because at least one component defining the air space chamber 8 slightly vibrates and the resonant frequency is low as a result.

The tightly closed air space chamber 8 is bordered by the bridge 5 and the end face 6 of the support component or bearing block 7 forming the wide sides of the air space chamber, and by the support surface 25 of the bridge 5 and a U-shaped frame-like component of elastic material 9 whose two parallel sides extend parallel to the plane of the drawing in FIG. 2 and whose middle component connecting the sides extends at a right angle relative to the plane of the drawing of FIG. 2.

Figure 3:
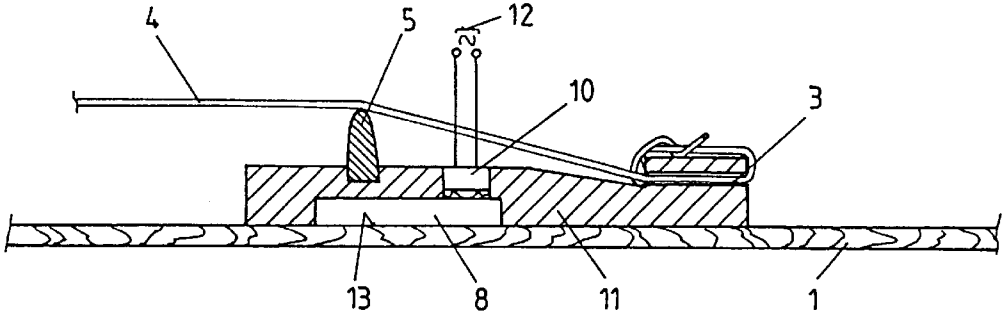
FIG. 3 is a longitudinal sectional view, on a larger scale, of a second embodiment of the present invention.

FIG. 3 shows another embodiment of the invention. In this embodiment, the air space chamber 8 is bordered by the instrument body 1 or its surface which forms a boundary surface 13 of the air space chamber 8. The other boundary surfaces of this air space chamber 8 are formed by the support component 11 secured to the instrument body 1, wherein the support component 11 also serves to anchor the strings 4. The diaphragm microphone 10 is also mounted in this support component 11. The bridge 5 on which the strings rest is placed on the surface of the support component 11 above that portion in which the air space chamber 8 extends. This configuration of the bridge is suitable for a guitar or a mandolin. Also in this case, the air space chamber 8 is tightly closed, the diaphragm microphone is enclosed in an airtight manner and is open toward the air space chamber 8. The electrical connections 12 extend outwardly.

Figure 5:
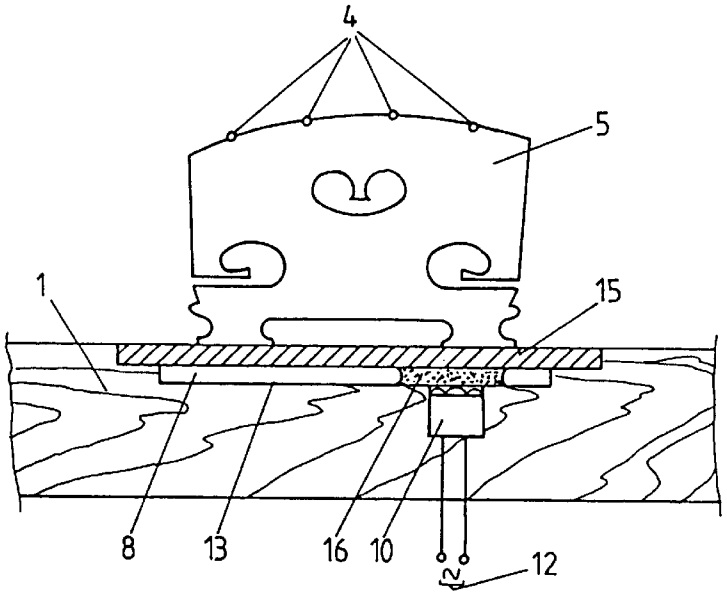
FIG. 5 is a cross-sectional view taken along sectional line V—V of FIG. 4.
Figure 4:
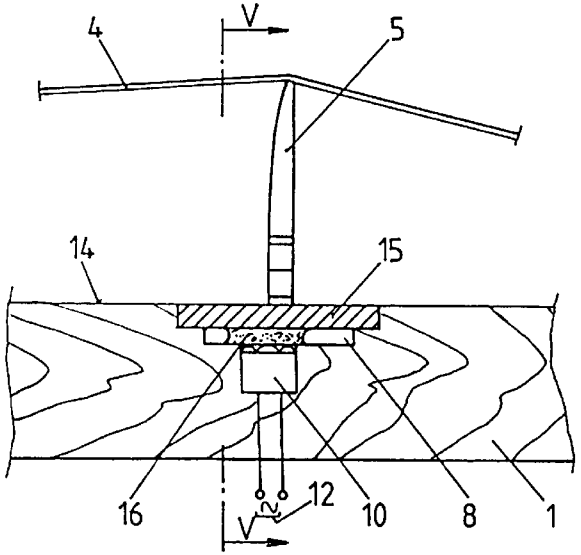
FIG. 4 is a longitudinal sectional view, on a larger scale, of a third embodiment of the present invention.

FIGS. 4 and 5 show a bridge according to the present invention for an electric violin. In this embodiment, the boundary surface 13 of the air space chamber 8 formed by the instrument body 1 is recessed relative to the surface 14 of the instrument body 1. The bridge 5 supporting the strings 4 is mounted on a plate 15 which is placed on and covers the recessed boundary surface 13. This plate 15 tightly closes the air space chamber 8. The diaphragm microphone 10 is secured to the instrument body 1. In this embodiment, the air space chamber 8 is additionally filled above the microphone 10 with an attenuating material, for example, a felt 16, in order to attenuate the great portion of high frequencies which prevail in string instruments in which a bow is drawn over the strings. The bridge 5 is constructed as in a conventional violin, and the bridge 5 may be glued onto the plate 15 or, as is usual in violins, the bridge may be held merely by the tension of the strings. The plate 15 and the bridge 5 also may be formed of a single-piece component.

Figure 6:
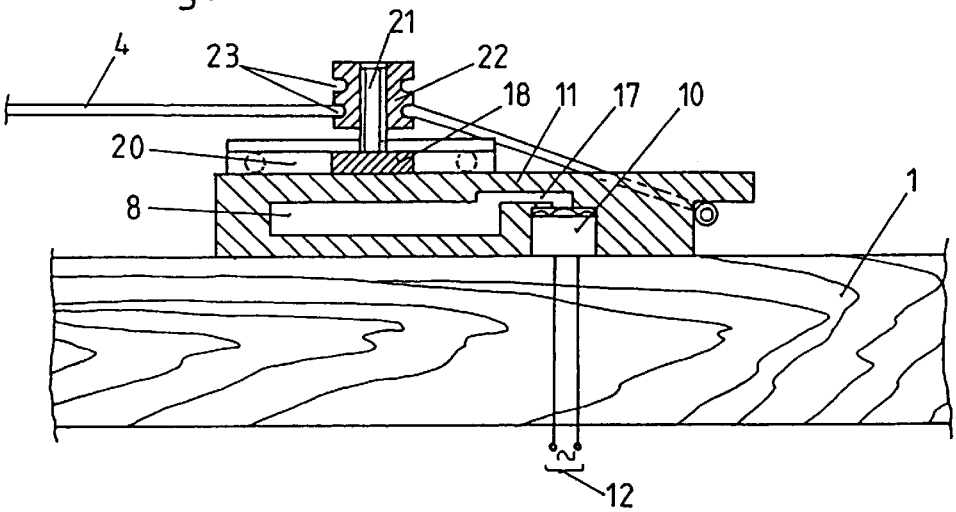
FIG. 6 is a longitudinal sectional view of a bridge of another embodiment of the present invention.
Figure 7:
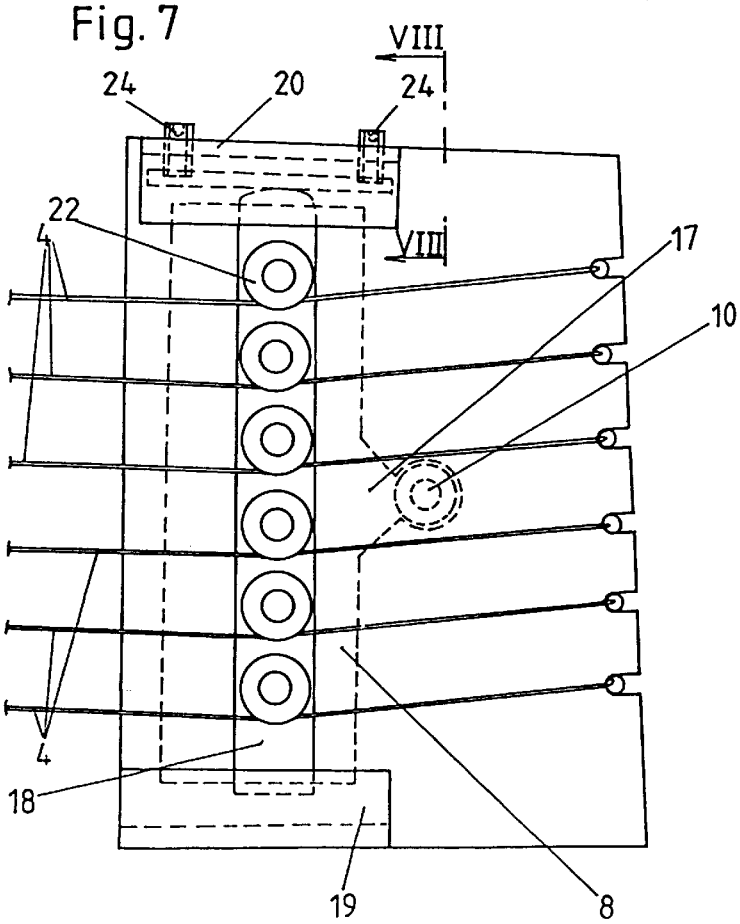
FIG. 7 is a top view of the bridge of FIG. 6.
Figure 8:
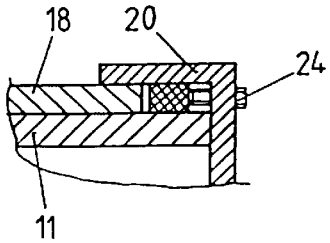
FIG. 8 is a cross-sectional view taken along sectional line VIII—VIII in FIG. 7.

FIGS. 6 and 7 of the drawing show another embodiment of the invention with adjustable spring support, for example, for an electric guitar. In this embodiment, in order to achieve a compact construction, the diaphragm microphone 10 is arranged laterally of the air space chamber and is connected to the air space chamber through an inner duct 17. The electrical connections 12 of the diaphragm microphone 10 extend downwardly into the instrument body and through appropriate ducts to the contacts provided for this purpose. The strings 4 are anchored at the rearward end of the support component 11 which completely contains the air space chamber 8. A bar 18 which extends transversely of the strings 4 and whose ends are held in guide members 19 and 20 is placed freely on the surface of the support component 11 and above the air space chamber 8.

Vertical threaded pins 21 whose number corresponds to the number of strings 4 are secured to this bar 18. A nut 22 is screwed onto each threaded pin 21, wherein the nut 22 has two circumferential grooves 23 which are located one above the other. The nuts 22 are constructed as knurled nuts. The strings 4 are placed in the grooves 23 and form an acute angle downwardly as well as to the side with its end anchoring points. This causes the bar 18 to be pressed onto the support component 11 and to be fixed in its position. One of the lateral guide members 20 serves as a stop. It is useful if this lateral guide member 20 is adjustable by means of screws 24, so that the bar 18 can be adjusted transversely of the strings 4 for correcting any inaccuracies or distortions of the instrument neck. This constructions makes it possible to adjust the height of the strings without using a tool, on the one hand, and, on the other hand, the transmission of the string vibrations to the bridge and, thus, to the air space chamber 8 is ensured in an optimum manner by the light vertical construction. Consequently, the vibrations of the strings reach the air space chamber 8 on the shortest direct path. The grooves 23 of the nuts 22 enlarge the range of the vertical adjustment of the strings without having to screw the nut substantially over the threaded pin 21. This ensures a substantially equal contact of the threaded components in the case of different heights of the strings. Experiments have shown that pure copper is advantageously used as the material of the threaded pins because copper conducts all frequencies most uniformly and its own sound is considered very pleasant as compared to other metals which could be used. The bar 18 can also be displaced in the direction of the strings 4 for adjusting the bridge purity.

In all embodiments of the invention, an airtight air space chamber 8 is provided in or on the bridge and underneath the strings 4. The vibrations of the strings and the elasticity of the bridge which may be composed of wood or a similar elastic material produce in the air space chamber 8 an air sound or sound pressure which is converted into an electrical signal by the diaphragm microphone 5 (for example, a miniature electrode capacitor microphone) constructed as a pressure pickup, which at the side of the diaphragm is open toward the air space chamber 8. When the components are adjusted correctly, an even and dynamic sound impression is produced over the entire audible range without the hard metallic sound of a piezoceramic sound pickup caused by resonances in the upper audible range. External sound cannot penetrate from the outside into the airtight closed air space chamber 8. This ensures a high feedback distance. In all embodiments shown in the drawing, the ends of the strings are placed and anchored on the support component 11. It is within the scope of the present invention to secure these ends on the instrument body.

The invention is not limited by the embodiments described above which are presented as examples only but can be modified in various ways within the scope of protection defined by the appended patent claims.

I claim:

1. A bridge for supporting strings of a musical instrument having an instrument body and an acoustic transducer, the bridge comprising an airtight closed air space chamber located in front of a sound receiving side of the transducer, the musical instrument further having a string zone across which the strings are located next to one another, wherein the air space chamber extends transversely of a longitudinal direction of the strings and across the string zone, and wherein the bridge supporting the strings is one of a boundary surface of the air space chamber and mounted on a wall forming a boundary surface of the air space chamber.

2. The bridge according to claim 1, wherein the acoustic transducer is a diaphragm microphone.

3. The bridge according to claim 1, wherein the air space chamber 1 has a boundary surface formed by the bridge, the air space chamber having at least three narrow sides formed by an elastic material, and wherein the bridge supporting the strings extends essentially perpendicularly of a surface of the instrument body and forms a wide side of the air space chamber.

4. The bridge according to claim 1, wherein a boundary wall of the air space chamber is formed by the instrument body.

5. The bridge according to claim 4, wherein the boundary wall of the air space chamber formed by the instrument body is recessed relative to the surface of the instrument body, and wherein the bridge supporting the strings is arranged on a plate covering the recessed boundary surface.

6. The bridge according to claim 5, wherein the recessed boundary surface forms a wide side of the air space chamber.

7. The bridge according to claim 1, comprising a plurality of vertical threaded pins arranged above an upper wide side of the air space chamber, a nut being mounted on each threaded pin, each nut having at least one outer circumferential groove for receiving a string.

8. The bridge according to claim 7, further comprising a bar placed on the upper wide side of the air space chamber, the threaded pins being mounted on the bar, wherein the bar is mounted so as to be displaceable transversely of the longitudinal direction of the air space chamber.

9. The bridge according to claim 7, further comprising a bar placed on the upper wide side of the air space chamber, the threaded pins being mounted on the bar, wherein the bar is mounted so as to be displaceable parallel to the longitudinal direction of the air space chamber.

10. The bridge according to claim 1, wherein the air space chamber is filled at least partially with an attenuating material.

11. The bridge according to claim 10, wherein the attenuating material is felt.

12. The bridge according to claim 7, wherein the threaded pins are of copper.

13. The bridge according to claim 7, wherein the nuts are knurled nuts.

* * * * *

UNITED STATES PATENT AND TRADEMARK OFFICE

CERTIFICATE OF CORRECTION

PATENT NO. : 5,925,839

DATED : July 20, 1999

INVENTOR(S) : Stephan Schertler

It is certified that error appears in the above-identified patent and that said Letters Patent is hereby corrected as shown below:

[30] Foreign Application Priority Data

Feb. 28, 1997 [AT] Austria.....344/97

Signed and Sealed this

Second Day of May, 2000

*Attest:*

Q. TODD DICKINSON

*Attesting Officer*

*Director of Patents and Trademarks*